United States Patent [19]

Zinsser et al.

[11] 4,251,189

[45] Feb. 17, 1981

[54] FAN

[75] Inventors: Rudolf Zinsser; Karl Prestl, both of Kelheim, Fed. Rep. of Germany

[73] Assignee: Heidolph & Zinsser GmbH, Kelheim, Fed. Rep. of Germany

[21] Appl. No.: 945,961

[22] Filed: Sep. 26, 1978

[30] Foreign Application Priority Data

May 13, 1978 [DE] Fed. Rep. of Germany ..... 2821142

[51] Int. Cl.[3] ..... F04D 29/32

[52] U.S. Cl. ..... 416/240; 416/241 A

[58] Field of Search ..... 416/62, 224, 240 R, 416/241, 247 R, 229

[56] References Cited

U.S. PATENT DOCUMENTS

| | | | |
|---|---|---|---|
| 2,033,345 | 3/1936 | Lee | 416/240 |
| 2,107,136 | 2/1938 | Zaiger | 416/229 |
| 2,251,887 | 8/1941 | Larsh | 416/229 |
| 2,949,092 | 8/1960 | Fortune | 416/62 |
| 2,962,999 | 12/1960 | Fortune | 416/62 |
| 3,294,315 | 12/1966 | Stewart et al. | 416/241 |
| 3,901,625 | 8/1975 | Witzel | 416/224 |

FOREIGN PATENT DOCUMENTS

| | | | |
|---|---|---|---|
| 131930 | 6/1902 | Fed. Rep. of Germany | 416/230 |

*Primary Examiner*—Leonard E. Smith
*Attorney, Agent, or Firm*—Jordan and Hamburg

[57] ABSTRACT

A fan blade has a protective beading on at least some of the edges thereof, the protective beading protecting against injuries while the fan is operating.

9 Claims, 4 Drawing Figures

Fig. 1
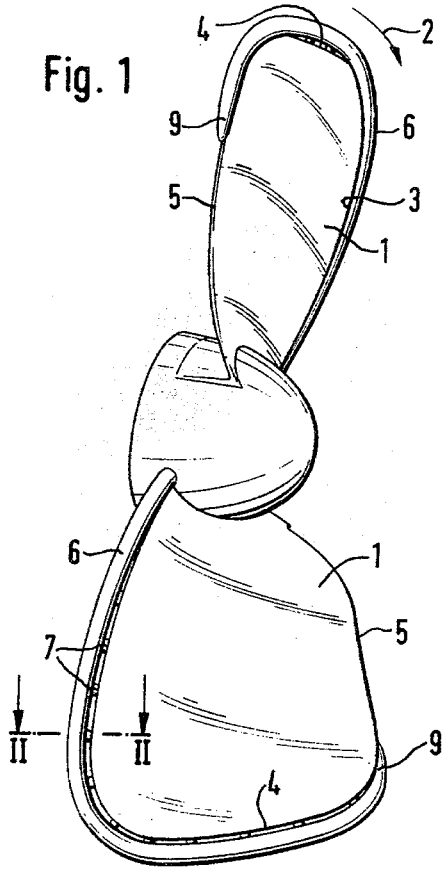
Fig. 2
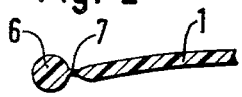
Fig. 3
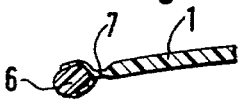
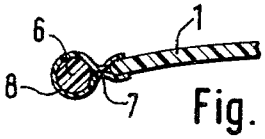
Fig. 4

FAN

BACKGROUND OF THE INVENTION

This invention relates to a fan and particularly to an axial flow fan with a protective device protecting against injuries caused by the fan blades.

Heretofore, the use of axial flow fans resulted in the danger that injuries could be caused by accidentally touching the relatively sharp edges of the fan blades while the fan was running. Therefore, most of such fans are provided with protective cages. However, such a protective cage, besides the considerable expense of construction, cannot satisfactorily solve the problem, because in order to perform adequately, the apertures of the protective cage must be very small so that even a child cannot put its fingers through them. Such small apertures have the disadvantage that the cage becomes an obstacle to the flow of air and thereby reduces considerably the efficiency of the fan. Furthermore, fans with a protective cage cause considerable noise, a fact which is frequently very deleterious.

In order to overcome these disadvantages, the present invention provides that at least the leading edges and the outer edges of the fan blades are covered by a protective beading. Such a protective beading may consist of a soft elastic material, for example, rubber or a plastic, and the beading may be fastened flexibly to the fan blade as a further embodiment of the invention.

Such a protective beading, according to the invention, can completely prevent injuries due to the introduction of a hand in the path of the fan blade and obviates a covering by a protective cage.

A flexible connection between the beading and the fan blade is readily effected by arranging the beading at a distance from the edges of the fan blade with the beading being connected to the blade by connecting elements or bars which are disposed at distances from each other. The connection may also be made out of one piece only by integrally molding a plastic blade together with the beading. In another embodiment, the beading may be glued to the fan blade or clamped on, in other words the protective arrangement according to the invention may also be used when the blades are made of metal.

Complete safety of the fan may be obtained by choosing an appropriate material for the protective beading and/or the arrangement of connecting it flexibly to the fan blade, such connection being influenced by the length and thickness of the protective beading. That can be achieved without causing, as when using protective cages, unwanted air noises and losses of energy due to obstacles in the path of the air flow. Furthermore, the protective arrangement according to the invention is considerably simpler and less expensive than known protective cage arrangement, particularly when the protective beading and the fan blade are made out of one piece.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

BRIEF DESCRIPTION OF THE DRAWINGS

FIG. 1 is a perspective view of a fan blade for an axial flow fan provided with a beading according to the present invention.

FIG. 2 is a partial sectional view taken along the line II—II in FIG. 1.

FIGS. 3 and 4 are partial sectional views similar to FIG. 2 but showing alternate embodiments for securing the beading to the fan blade.

DESCRIPTION OF THE PREFERRED EMBODIMENTS

The axial fan blade arrangement shown in FIG. 1 includes two convex blades 1 and the arrow 2 indicates the direction of rotation. The leading edges 3 and the outer radial edges 4 as well as a segment of the trailing edge 5 of the blades 1 are covered by a protective beading 6 which, in the embodiments of FIGS. 1 and 2, is molded integrally to the plastic fan blades, and is connected by the integral elements or bars 7 to the edges 3, 4 and 5. Instead of this one-piece construction of the beading 6 and the blades 1, the beading 6 may also be clamped to the blade 1 as shown in FIG. 3 in which case eventually the clamp mounting parts may be molded unto the beading, so that the clamp mounting occurs on the outer rim of the blade 1. This latter construction, for example, is preferred when using metallic blades. For such metallic blades it is also particularly useful to utilize the connection shown in FIG. 4 wherein an adhesive band 8 encircles the beading and functions as an adhesive bond to the blade 1. When connecting the beading 6 to the blade 1, the ends of the beading should be efficiently fastened so that they do not flutter or even tear themselves loose from the blade. This, for instance, is possible at the outer end 9 of the beading by tapering this end off at one end and applying a slot at the other end and making the edge of the blade 1 protrude into this slot and to ensure this connection by an added adhesive bond.

The invention is not restricted to the illustrated embodiments. Many other connections between the beading and the blade may be utilized. For example, the beading may be provided along its whole length with a clamping groove so that the blade and the beading may be clamped together. The thereby obtained clamp connection may be reinforced by an adhesive. Furthermore, it is possible to weld together the beading and the blade. It is also possible to form a connection of the blade and the beading by a so-called plastic hinge.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A fan blade having leading and trailing edges, a protective beading of soft elastic material spaced from said leading edge, and connecting elements flexibly connecting said protective beading to said fan blade, said connecting elements being spaced from one another to thereby define open spaces between successive connecting elements and between said leading edge and said protective beading.

2. A fan blade having leading and trailing edges, a protective beading of soft elastic material located on at least said leading edge, said protective beading being spaced from said leading edge, and flexible means comprising a plurality of connecting elements disposed in said space between said protective beading and said leading edge and extending from said leading edge to said protective beading, each of said connecting elements being spaced from one another such that open spaces are formed between successive spaced connecting elements, whereby said spaced connecting elements flexibly connect said protective beading to said fan blade.

3. A fan blade according to claim 2, wherein said soft elastic material is rubber.

4. A fan blade according to claim 2, wherein the soft elastic material is plastic.

5. A fan blade according to claim 2, wherein said protective beading is integrally molded with said fan blade.

6. A fan blade according to claim 2, wherein said protective beading is secured to said fan blade by adhesive means.

7. A fan blade according to claim 2, wherein said protective beading is connected to said fan blade by plastic hinge means.

8. A fan blade according to claim 2 wherein said fan blade has an outer radial edge, said protective beading extending along said outer radial edge.

9. A fan blade according to claim 8 wherein said protective beading is spaced from said outer radial edge, and spaced connecting elements connecting said protective beading to said outer radial edge.

* * * * *